United States Patent [19]

Roebuck

[11] 4,299,019

[45] Nov. 10, 1981

[54] DIE-SET COMBINATION FOR MAKING PIN-BACK BADGES

[75] Inventor: Malcolm J. Roebuck, LaSalle, Ill.

[73] Assignee: Badge-A-Mint Ltd., LaSalle, Ill.

[21] Appl. No.: 24,154

[22] Filed: Mar. 26, 1979

[51] Int. Cl.[3] ..... B23P 11/00
[52] U.S. Cl. ..... 29/243.52
[58] Field of Search ..... 29/243.52, 243.5

[56] References Cited

U.S. PATENT DOCUMENTS

| | | | |
|---|---|---|---|
| 219,275 | 9/1879 | Knapp | 29/243.52 |
| 756,837 | 4/1904 | Devine | 29/243.52 |
| 2,162,731 | 6/1939 | Lyon | 29/243.52 |
| 3,795,036 | 3/1974 | Roebuck | 29/243.52 |

*Primary Examiner*—James L. Jones, Jr.
*Attorney, Agent, or Firm*—Rummler & Snow

[57] ABSTRACT

The present invention concerns a combination of mutually interfitting die and press-block elements adapted for manual use and operation with each other to produce a finished and permanent assembly of the separate components of a pin-back button or badge.

2 Claims, 7 Drawing Figures

DIE-SET COMBINATION FOR MAKING PIN-BACK BADGES

BACKGROUND OF THE INVENTION

Generally pin-back badges are made by assembling the components of the badge by means of a progressive die press in which several die-forming operations are mechanically performed. This requires a rather bulky and costly apparatus, usually too large or heavy for esy storage or transportation and, in general, not suited for home use or for fun. Thus the primary object of the present invention is to provide a set of block-like plastic elements that can be readily used at home by almost anyone to make pin-back badges as desired without the need for other tools or apparatus except the preformed body, shell and cover components of the complete badge. This is an improvement on my U.S. Pat. No. 3,795,036 granted Mar. 5, 1974.

SUMMARY OF THE INVENTION

The gist of the invention as herein disclosed resides in the provision of a set of all-plastic forming elements designed for interrelation with each other in a particular sequency for entirely manual operation to perform the several assembly and formation steps of the process for making finished pin-back buttons or badges. A complete set of the said elements comprises a pressure member, a forming ring, a forming die with means to removably secure the ring to the die, a hammer member, each element being of cylindrical form and made of nonresilient plastic material, and an annular solid metalic member. All of these elements are dimensioned to interfit with each other for making a button or badge of predetermined size; and the badge components to be assembled comprise a flanged shell over which the cover material is applied, suitable cover material in disc form, and a body member to which a pin is attached, and latching means for removably anchoring the ring and die together.

DESCRIPTION OF THE PREFERRED EMBODIMENT

The pin-back button or badge to be made by the use of my invention comprises a shallow axially-flanged metal shell 10, over which circular paper and plastic cover sheets 12 and 14 are applied to carry the picture or message for the badge, and a body or backing disk 16 carries a pin 18 by which the badge can be attached to the wearer's clothing. These components of the badge are conventional and readily available preformed devices, and form no part of the present invention.

Figure 1:
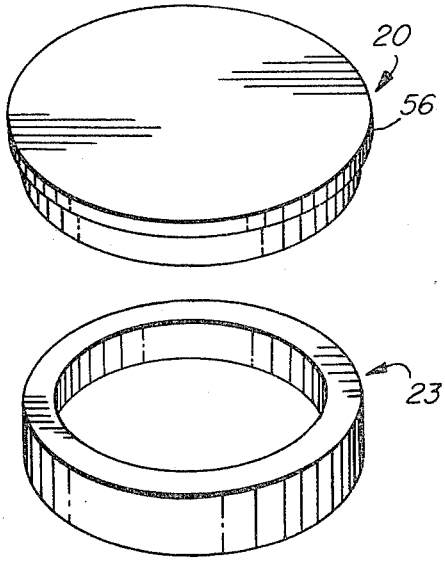
FIG. 1 is a perspective exploded view showing the five elements comprising the die-set of my invention.
Figure 2:
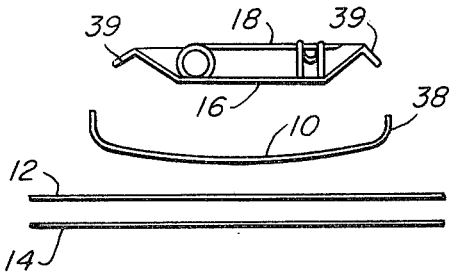
FIG. 2 is an exploded view showing the components of a typical badge to be assembled by means of the elements shown in FIG. 1.
Figure 2:
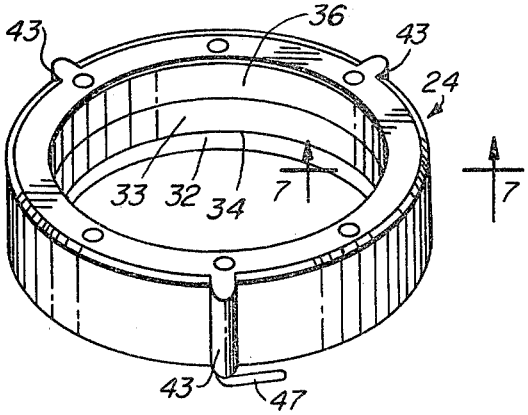
Figure 7:
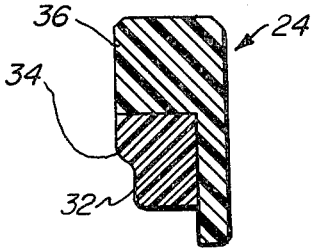
FIG. 7 is a cross-sectional view taken on the lines 7—7 of the forming die of FIG. 1.
Figure 7:
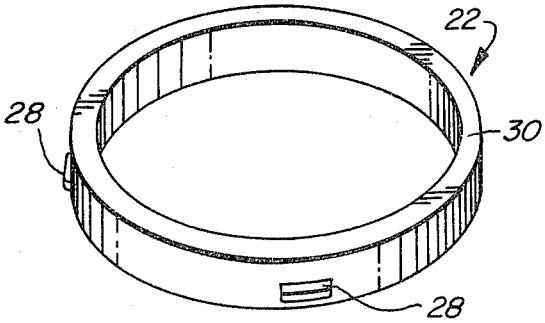
Figure 7:
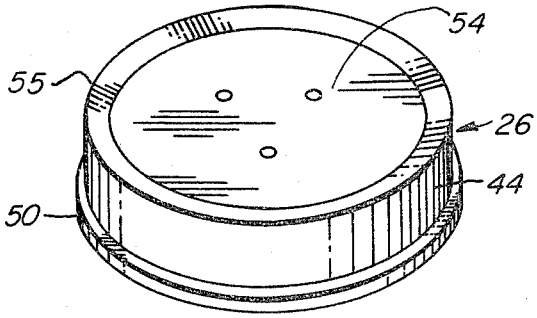

As shown in FIG. 1, the die-set of my invention comprises a cylindrical pressure member 20, a cylindrical ring 22, a ring-like cylindrical forming die 24, a cylindrical member 23 of hard plastic, and a solid cylindrical hammer member 26. The ring 22 has concentric, axially parallel inside and outside walls and the internal diameter of ring 22, which is the same as the diameter of the badge or button to be made by the dieset, determines the working diameters of all of the other elements of the die-set. The axial length of this ring 22 also sets the axial measurement of the other element of this set. The outer wall of the ring 22 is provided with three short, outwardly extending flanges or shoulders 28 spaced equidistantly apart and medially of the edges of the ring.

Figure 3:
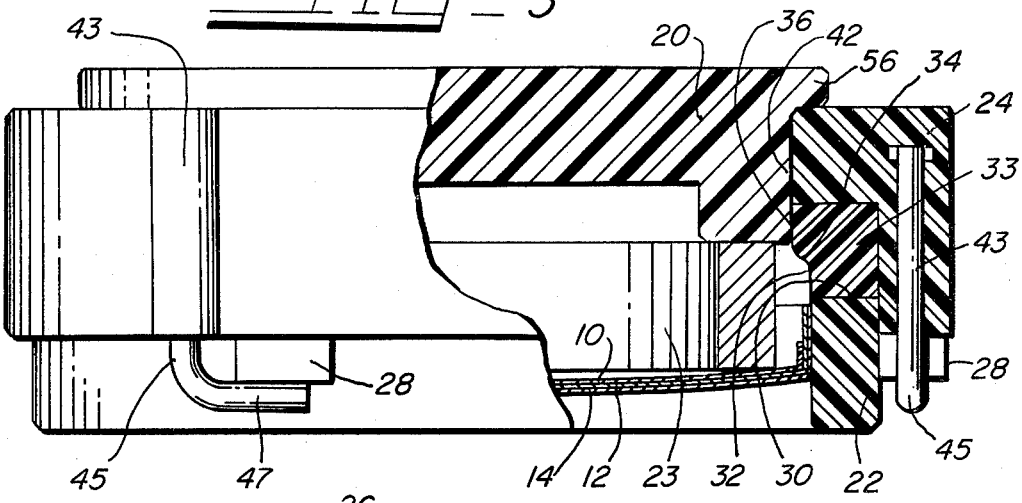
FIG. 3 is a side elevational view, with parts in section, of a badge shell and paper and plastic cover shown disposed in the die-set before the hammer is inserted.
Figure 4:
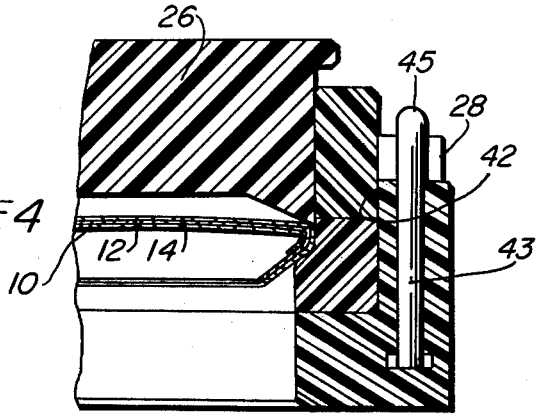
FIG. 4 is a partial sectional view showing the assembled shell and cover material in the forming die with the backing disk in place, the device inverted from that shown in FIG. 1.

As shown by FIGS. 3 and 4, the forming die 24 has an outside diameter greater than the ring 22. The die 24 is provided with a hard plastic member 33 integrally formed on the inner surface of the die and at one end is provided with a flat radial surface 30, defined by a rim 32. The inner diameter of the forming die 24 at this one end is made the same as the inner diameter of the forming ring 22, to serve as a continuation thereof and to provide a wall which terminates at an inwardly and downwardly curved shoulder 34 which, in turn, defines the upper end of a second wall 36 extending to the other end of the forming die 24. The length of the wall 36 is preferably only slightly longer than the width of the flange 38 on the shell 10 of the button to be made by the die-set, so that the free end of the said flange 38 can rest on the shoulder 34 to hold the shell near the level of the end surface 30 preparatory to the first forming operation, as shown in FIG. 3. The width of the shoulder 34 is preferably only slightly greater than the thickness of the shell flange 38 plus the combined thicknesses of the cover sheets 12 and 14 and the curvature is similar to a quarter-round. The length of the wall 42 is preferably about one-third the total thickness of the forming die 24. The width of the wall 32 is wide enough so as to receive cover sheets 12 and 14. This also determines the thickness of the ring 22.

The hard plastic ring 23 has an outside diameter substantially equal to or less than the inner diameter of the wall 42 of the die 24.

The die is provided with three equi-distantly spaced, elongated, vertical seats 43 in which latches 45 are rotatively seated. Each latch 45 has an arm 47 extending at right angles arranged to engage the shoulders 28 on the ring 22 when the ring is seated in the die 24 to anchor the ring in the die.

Figure 6:
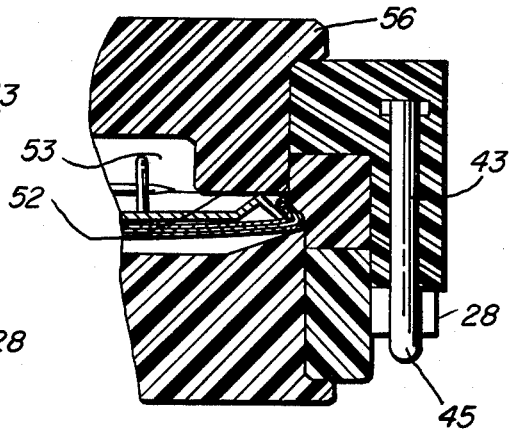
FIG. 6 is a partial cross-sectional view with the shell and backing in completed position in the forming members.

The member 20 has two functions; first to perform the first forming operation with the ring 23 by driving the shell and cover elements into the forming ring 22 from their initial position overlying the forming ring, as indicated in FIG. 3; and secondly to perform the finishing operation of clinching the flange of the shell over the inturned margins of the cover sheets and the margin of the body or backing disk 16, as indicated in FIG. 6.

The member 20 has an integral annular enlarged head 56 which has flat radial sides. The end 52 of the member 20 is centrally recessed as at 53 to provide clearance for the body pin 18 during the clinching operation.

The pressure member 26 of the die-set of this invention is made with a diameter that will allow a sliding fit into the forming ring 22 only, as shown in FIG. 4, and has a central recess 54. The margins of the recess are angularly disposed at 55 in an upward direction. The length of the pressure member 26 beyond the flange 56 is made to pass through the forming ring 22 and into the forming die 24, when these members are combined as in FIGS. 4, 5 and 6, a distance sufficient to drive the combined shell and cover sheets of FIG. 3 against the rounded shoulder 34 in the die 24 far enough to turn the free edges of the paper and cover sheets inwardly over the edge of the flange 38 and to turn the edge of the flange 38 slightly beyond the inner edge of the shoulder 34. At that point, the flange 56 acts as a stop, by engagement with the end of the forming ring 22, and prevents turning the shell flange 10 too far inwardly so as to interfere with the reception of the body or backing member 16 for the final button making operation.

The procedure for making a button or badge with the herein-disclosed die-set begins assembling the shell 10 and cover sheets 12 and 14 in the forming die 24 when it is inverted from that shown in FIG. 1, or as shown in FIG. 4 of my aforesaid patent. The shell 10 rests with its flanges 38 edgewise on the shoulder 34 and the cover sheets overly the shell and extend over the surface 30. The forming ring 22 is then set into the forming die and latched in place by the latch 45 with the arm 47 extending over the flange 28 on the ring 22, and this assembly is inverted as in FIG. 3 and set on a table top. Then the ring 23 and the end portion 55 of the member 20 are set into the now upper end of the forming die and manually pressed downward until the flange 38 and the cover sheets are forced into the forming ring 22 (see FIG. 3).

Then the element 20 and ring 23 are removed and the ring 22 and die 24 combination is again inverted to its original position (see FIG. 4) and the pressure element 26 is inserted into the forming ring 22 and manually pressed downwardly to force the combined shell and cover sheets from the ring 22 into the forming die 24. The result is that the margins of the cover sheets are turned inwardly and over the edge of the shell flange 38 by the inwardly curved shoulder 34, as shown in FIG. 4. As shown, the cover sheet margins extend beyond the flange 38 to provide means to secure the cover sheets on the finished button.

Figure 5:
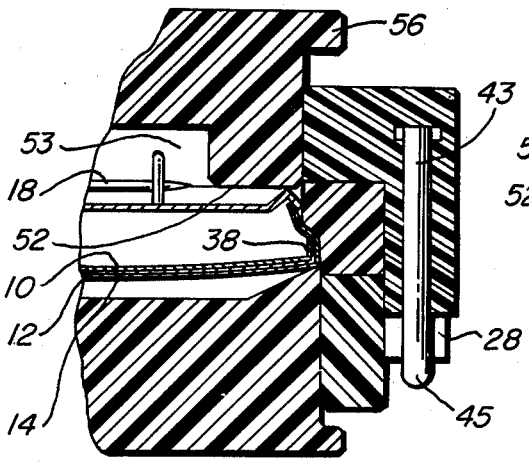
FIG. 5 is a partial cross-sectional view similar to FIG. 3 but showing the edges of the shell shifted interiorly and the backing disk in place.

The next step is to again invert the combination as shown in FIG. 5 and insert the backing member 16 into the die with its margins overlying the inturned margins of the cover sheets, and to then insert the end of the member 20 on the same and into the open end of the forming die 24. Then the member 10 is placed thereover in the die and both are pressed together to push the body member 16 into engagement with the shell 10. This tucks the free end margins of the cover sheets between the shell flange 38 and the marginal bead 39 of the backing member 16 as the edges 52 of the body member become bottomed against the shell.

The final step is to clinch the flange 38 agains the bead 34 of the body 10 to complete the assembly of the button or badge. Pressure on the member 26 for this final badge forming operation is not sufficient to complete the clinching operation and to obtain a force great enough for that purpose the die-set assembly can be inverted and placed in a hand press to force the shell flange 38 against the curved shoulder 36 and turn the flange 38 inwardly toward the body bead 38 to clamp both the cover sheet margins and the badge body 16 to the shell 10. Now the die-set elements 10, 24, 22 and 26 can be separated and the finished button or badge removed.

As shown in FIG. 5, the recess 53 will provide space for the pin 18, when a pin is used, and the bead 39 on the backing member 16 provides for pressing the body below the free edge of the flange 38 so as to tuck the cover sheet margins between the flange 38 and bead 39 to be clamped when the flange is clinched by the pressure element 26.

A particular advantage of this invention resides in its simplicity of form and manufacture, all elements being annular pieces capable of being readily made in a plastic die. Other advantages are to be found in the fact that the several elements comprising the set of tools are, by shape and design, used in a logical sequence and can be operated manually by almost any person without the need for other equipment other than the several parts comprising the badge or button to be made.

Although but one embodiment of this invention is herein shown and described, it will be understood that details of the construction comprising the invention may be altered or omitted without departing from the spirit of the invention as defined by the following claim.

I claim:

1. An all plastic die-set for use in making permanent badges out of a conventional pin-back, shell having a marginal flange and an indicia-bearing paper assembly, and a clear plastic covering therefor, comprising:

(a) a cylindrical forming ring having a flat face normal to the ring axis at each end and an inside diameter substantially equal to the diameter of the badge to be made and having an outer sidewall;
  (1) said ring having three equi-distantly spaced flanges on the outer sidewall of said ring spaced medially between said faces;

(b) a cylindrical pressure member having an outside diameter gauged for sliding fit into said forming ring, a radial flange at one end, and a cavity at the other end, the margin of the cavity having an upstanding circular flange and an inwardly extending annular wall;

(c) a hollow cylindrical forming die having an outer wall, a shoulder at one end, the inside diameter of which is gauged to slidably receive said forming ring, the inside diameter of the forming die at said one end being equal to the outside diameter of said forming ring to provide a first wall which terminates inwardly of the die in a concavely-curved shoulder to define the inner end of a second wall extending to the other end of the forming die, the inside diameter of the second wall being substantially the same as the inside diameter of the shell and its flange for the badge to be made;
  (1) three equi-distantly spaced elongated seats formed on said outer wall;
  (2) a rotary latch means in said seats having a right angled arm coacting with said flanges on the sidewall of said ring to removably anchor said ring to said die;

(d) a cylindrical hammer member having an outside diameter gauged for sliding fit into said other end of the forming die, one end of said hammer member having an integrally formed, enlarged surface, the interior of said hammer member being hollow below said enlarged surface; and (e) a hard plastic pressure ring.

2. A die-set for use in making permanent badges out of a conventional pin-back, shell having a marginal flange and indicia-bearing paper assembly, and a clear plastic covering therefor, comprising:

(a) a cylindrical forming ring having a flat face normal to the ring axis at one end and the inside diameter substantially equal to the diameter of the badge to be made and having an outer sidewall;

(b) a cylindrical pressure member having an outside diameter gauged for sliding fit into said forming ring, a radial flange at one end and a cavity at the other end, the margin of the cavity having an upstanding circular flange and an inwardly extending angular wall;

(c) a hollow cylindrical forming die having an outer wall, a shoulder at one end defined by a radial rim, the inside diameter of which is gauged to slidably receive said forming ring, the inside diameter of the forming die at said one end being equal to the outside diameter of said forming ring to provide a first wall which terminates inwardly of the die in a concavely curved shoulder to define the inner end of a second wall extending to the other end of the forming die, the inside diameter of said second wall being substantially the same as the diameter of the shell and its flange for the badge to be made; and (d) a cylindrical hammer member having a radial rim at one end and a concentric portion extending from one side of said rim and having an outside diameter gauged for sliding fit into said other end of said forming die.

* * * * *